United States Patent [19]

Le Blanc, Jr.

[11] 4,407,390

[45] Oct. 4, 1983

[54] PNEUMATIC MOTOR

[75] Inventor: Louis H. Le Blanc, Jr., Claremont, N.H.

[73] Assignee: Joy Manufacturing Company, Pittsburgh, Pa.

[21] Appl. No.: 291,025

[22] Filed: Aug. 7, 1981

Related U.S. Application Data

[62] Division of Ser. No. 77,246, Sep. 19, 1979, Pat. No. 4,308,925.

[51] Int. Cl.[3] ..... F01N 1/08

[52] U.S. Cl. ..... 181/230; 181/264; 173/DIG. 2

[58] Field of Search ..... 181/202, 230, 264, 198; 173/DIG. 2

[56] References Cited

U.S. PATENT DOCUMENTS

| | | | |
|---|---|---|---|
| 3,402,560 | 9/1968 | Alm | 181/230 X |
| 3,719,251 | 3/1973 | Hedrick | 181/230 |
| 4,189,917 | 2/1980 | Gunning | 173/DIG. 2 X |

*Primary Examiner*—Benjamin R. Fuller

*Attorney, Agent, or Firm*—Buell, Blenko, Ziesenheim & Beck

[57] ABSTRACT

Reciprocating pneumatic motor for rock drills and the like wherein a freely-movable hammer piston repeatedly strikes the end of a drill rod, usually a rotating drill rod. Fluid under pressure enters a single, central inlet port in the wall of a cylinder which houses the piston with alternate cycling ports being incorporated into the piston itself. Also disclosed is a novel muffler for such a pneumatic motor.

3 Claims, 1 Drawing Figure

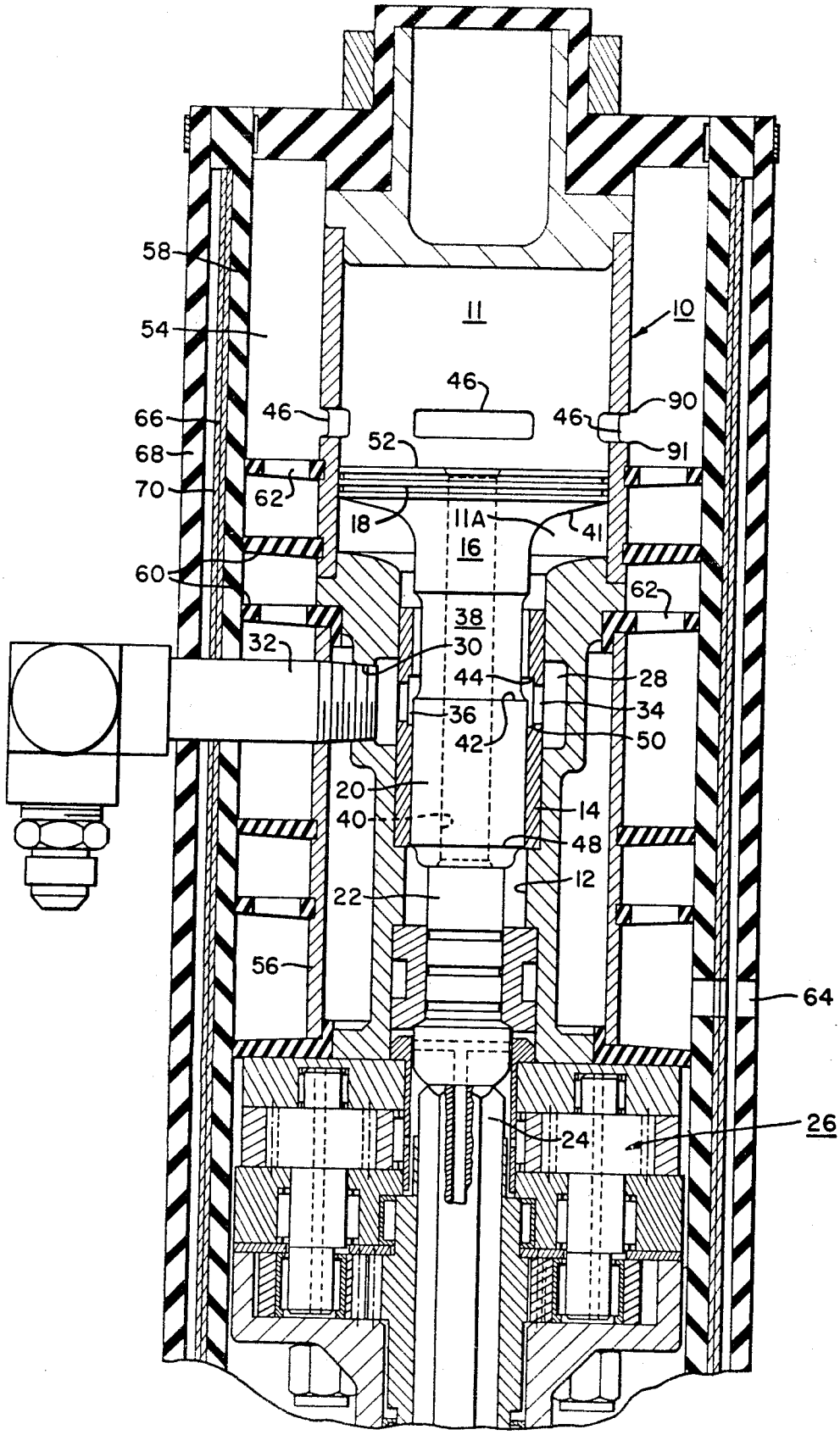
58
54
11
10
46
66
46
46
90
68
52
91
70
62
18
11A
41
16
60
62
38
32
30
44
28
36
34
42
50
20
14
40
48
12
22
56
64
24
26

PNEUMATIC MOTOR

This is a division of application Ser. No. 77,246, filed Sept. 19, 1979 now U.S. Pat. No. 4,308,925.

BACKGROUND OF THE INVENTION

While not limited thereto, the present invention is particularly adapted for use in pneumatic rock drills of the type in which a rotating drill rod is reciprocated by means of a hammer piston which repeatedly strikes the end of the drill rod opposite a drill bit. In such drills, the hammer piston delivers a blow upon the drill rod at one end of its downward stroke, the initial propulsion of the piston toward the rod being due to expansion of a fluid under pressure; while the final portion of the stroke is due to the inertia of the piston and any residual pressure in the cylinder after the fluid pressure source has been cut off. Similarly, the upward stroke of the hammer piston is initiated by fluid under pressure; while the remainder of the upward stroke is due to the inertia of the piston and/or any residual pressure in the cylinder.

In the past, many pneumatic motors of this type have required a plurality of input ports extending through the wall of a cylinder which houses the hammer piston. This, however, increases the cost of the assembly. Furthermore, prior art designs as exemplified, for example, in U.S. Pat. Nos. 873,938, 1,128,416, 1,660,201, 1,800,344, 2,748,750 and 3,329,068 have been deficient in one respect or another as regards the efficiency and cost of the pneumatic motor.

SUMMARY OF THE INVENTION

In accordance with the present invention, a pneumatic motor for impact tools and the like is provided wherein a single input port, connected to a source of fluid under pressure, is provided in the wall of a cylinder which houses a hammer piston. The design is simple, efficient and inexpensive.

Specifically, and in accordance with the invention, there is provided a pneumatic motor comprising a cylinder having a large diameter portion communicating with a smaller diameter portion. A hammer piston is reciprocable within the cylinder and has an upper portion disposed within the large diameter portion of the cylinder and a lower portion disposed within the small diameter portion of the cylinder. A central bore extends through the upper and lower portions of the piston; while a single input port extends through the wall of the smaller diameter portion of the cylinder intermediate the ends of the smaller diameter piston portion. This input port is adapted to communicate with a reduced diameter area in the outer peripheral surface of the lower portion of the piston, the reduced diameter area being out of sliding engagement with the wall of the smaller diameter portion of the cylinder and being adapted in one position of the hammer piston to connect the input port to a lower side of the upper piston portion to force it in an upward direction. In a second position of the hammer piston, the input port is connected through the central bore of the piston to the upper side of the large diameter piston portion to force it in the opposite direction.

One or more exhaust ports is provided in the cylinder opposite the large diameter portion of the piston, the exhaust ports being in communication with the central bore of the piston when the inlet port is in communication through said reduced diameter area with the lower side of the upper piston to force it upwardly. On the other hand, when the inlet port is no longer in communication with the lower side of the upper piston portion during the upward stroke, the exhaust ports are then in communication with the same lower side of the upper piston portion. On the downward stroke, air entering through the inlet port under pressure passes through the central bore of the piston acting on its upper surface to force it downwardly. After the piston has moved downwardly to the point where its upper surface is no longer connected to the inlet port, the expended air passes out of the exhaust ports. The exhausted air then passes through a muffler surrounding the motor and having walls preferably formed from an elastomer.

The above and other objects and features of the invention will become apparent from the following detailed description taken in connection with the accompanying cross-sectional single FIGURE drawing which illustrates one embodiment of the invention.

With reference now to the drawing, the pneumatic motor shown comprises a cylinder 10 having a large diameter portion 11 which communicates with a lower small diameter portion 12. Disposed on the inner periphery of the small diameter portion 12 is a buffer ring 14 which, for purposes of the present specification and the claims which follow, will be considered to be part of the lower portion 12 of the cylinder 10. Reciprocable within the upper and lower portions 11 and 12 of the cylinder is a hammer piston 16 having an upper large diameter portion 18 reciprocable within the upper large diameter portion 11 of the cylinder 10 and a lower smaller diameter portion 20 reciprocable within the lower small diameter portion 12. As shown, the piston portion 20 is reciprocable within the inner periphery of the buffer ring 14. The piston 16, as it reciprocates within the upper and lower portions of the cylinder 10, is adapted to engage or strike a tappet 22 which engages the upper end of a drill rod 24, thereby imparting a reciprocating or striking motion to the drill rod 24 and a drill bit, not shown, carried at its other end. A motor, generally indicated by the reference numeral 26, is utilized to rotate the drill rod 24 about its axis. The motor 26 is one of a number of different types which can be employed and forms no part of the present invention.

Formed in the wall of the small diameter portion 12 of the cylinder 10 is an annular space 28 which, in turn, communicates with a single inlet port 30. Threaded into port 30 is an inlet conduit 32 adapted for connection through suitable valving to a source of fluid under pressure. The annular space 28, in turn, is connected through ports 34 in the buffer ring 14 to an inner annular space 36.

Formed in the outer periphery of the small diameter portion 20 of piston 16 is a reduced diameter area portion 38. Extending through the piston 16 is an internal bore 40. In the position of the piston shown in the drawing, the annular space 28 is connected through ports 34, annular space 36, and the reduced diameter area 38 to the underside 41 of the large diameter portion 18 of piston 16. Consequently, under these circumstances, fluid under pressure will force the piston 16 upwardly until the lower edge 42 of the reduced diameter area 38 intersects the upper edge 44 of the annular space 36. At this point, the source of fluid under pressure, not shown, is disconnected or cut off from the underside 41 of the large diameter piston portion 18; however the piston 16 will continue its upward movement due to the momentum imparted to its as well as the expansion of air trapped under the piston in chamber 11A. During the initial upward stroke of the piston 16, air within the chamber 11 is exhausted through exhaust ports 46. However, after the lower edge 42 of area 38 intersects the upper edge 44 of annular space 36, a point is reached where the air within chamber 11 is no longer exhausted through ports 46 (i.e., after the upper side 52 of piston portion 18 intersects the upper edge 90 of exhaust port 46). The remaining air in chamber 11 then compresses to decelerate the upward stroke of the piston 16. As the piston 16 continues its upward movement, a point will be reached where the lower edge of portion 18 reaches lower exhaust port edge 91 whereby air in chamber 11A begins exhausting out of ports 46. The lower edge 48 of piston portion 20 intersects the lower edge 50 of the annular space 36 sometime later. Under these circumstances, the inlet port 30 is connected through ports 34, annular space 36 and the internal bore 40 in the piston 16 to the upper side 52 of the large diameter piston portion 18. Consequently, the piston is now forced downwardly with pressure being applied to the upper side 52 until the lower edge 48 again intersects the lower edge 50 of annular space 36. At this point, the upper side 52 of the piston is disconnected from the source of fluid under pressure; however the piston will continue its downward movement until it strikes the tappet 22. As the piston moves downwardly, a point is reached where fluid under pressure in the cylinder portion 11 is exhausted through the ports 46. Thus, as long as fluid under pressure is supplied to the annular space 28, a continual reciprocating or hammering motion of the piston 16 will be achieved.

Surrounding the lower cylinder portion 12 is a cylindrical sheath 56. The ports 46 communicate with an annular space 54 formed between the outer wall of the cylindrical portion 10, the cylindrical sheath 56 and an outer wall 58 preferably formed of an elastomer or the like. Disposed within the space 54 are annular spacers 60 formed of an elastomer or the like, each spacer 60 has openings 62 therein, with the openings in one spacer being displaced 90° about the cylinder axis with respect to those in the next adjacent spacer. The exhausted air, after passing through the openings 62 in spacers 60 finally vents to the atmosphere through port 64.

Disposed on the outer periphery of the wall 58 is a pair of laminated aluminum or the like sheaths 66. These are spaced from the final outer wall 68 of the assembly, also formed from an elastomer, by an annular space 70.

Although the invention has been shown in connection with a certain specific embodiment, it will be readily apparent to those skilled in the art that various changes in form and arrangement of parts may be made to suit requirements without departing from the spirit and scope of the invention. In this respect, it will be apparent that while the the terms "upper", "lower", "upward" and "downward" are used herein and in the appended claims to describe the cylinder and piston parts, the invention is not limited to a vertical configuration and can be used in any inclination with respect to vertical, and can even be inverted.

I claim as my invention:

1. In a pneumatic motor having cylinder means, a piston reciprocable within said cylinder means, ports in the wall of said cylinder through which exhaust gas passes, and a muffler surrounding said cylinder for receiving said exhaust gas, the improvement in said muffler comprising:

an annular wall of resilient material surrounding said cylinder means;

annular spacers separating said wall from said cylinder means;

openings in said spacers through which exhaust gas can pass, said opening in at least some spacers being displaced about the cylinder axis with respect to the opening in a next adjacent spacer, whereby exhaust air will after passing in a generally longitudinal direction with respect to said cylinder axis flow generally circumferentially to the next said opening, and an opening in said annular wall through which exhaust gas passes to the atmosphere after passing through the openings in said spacers.

2. The combination of claim 1 wherein said annular wall includes a pair of elastomer sheets radially spaced from each other to form an annular void therebetween.

3. The combination of claim 2 including an annular sheath of metallic material disposed within said annular void.

* * * * *

UNITED STATES PATENT AND TRADEMARK OFFICE

CERTIFICATE OF CORRECTION

PATENT NO. : 4,407,390

DATED : October 4, 1983

INVENTOR(S) : Louis H. Le Blanc, Jr.

It is certified that error appears in the above-identified patent and that said Letters Patent is hereby corrected as shown below:

Column 2, last line, "its" should be --it--.

Claim 1, column 4, line 30, "opening" should be --openings--.

Signed and Sealed this

Tenth Day of January 1984

[SEAL]

*Attest:*

GERALD J. MOSSINGHOFF

*Attesting Officer*

*Commissioner of Patents and Trademarks*